US006379854B1

(12) United States Patent
Fujikura

(10) Patent No.: US 6,379,854 B1
(45) Date of Patent: Apr. 30, 2002

(54) DEVELOPING AGENT AND IMAGE FORMING DEVICE

(75) Inventor: Yukihiro Fujikura, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/609,313

(22) Filed: Jun. 30, 2000

(51) Int. Cl.[7] ..... G03G 9/083
(52) U.S. Cl. ..... 430/106.1; 430/111.4
(58) Field of Search ..... 430/106.6, 106, 430/109, 110, 111, 106.1, 111.4

(56) References Cited

U.S. PATENT DOCUMENTS 5,225,302 A * 7/1993 Isoda et al. ..... 430/106.6
5,872,443 A * 2/1999 Williamson ..... 320/21

FOREIGN PATENT DOCUMENTS

JP 11-304762 11/1999

* cited by examiner

*Primary Examiner*—John Goodrow
(74) *Attorney, Agent, or Firm*—Foley & Lardner

(57) ABSTRACT

A developing agent comprising a toner particle containing a magnetic powder and a binder resin, the kinetic resistance of the developing agent being not higher than 200 MΩ, and the absolute value of the difference ΔV between the maximum value and the minimum value of the surface potential of the developing agent layer on a developing sleeve being not larger than 5V, is used for obtaining satisfactory developing agent image high in image density and low in fogging.

9 Claims, 3 Drawing Sheets

DEVELOPING AGENT AND IMAGE FORMING DEVICE

BACKGROUND OF THE INVENTION

The present invention relates to an image forming apparatus such as an electrophotographic apparatus or an electrostatic recording apparatus and to a developing agent used in the image forming apparatus, particularly, to an image forming apparatus in which the development is performed by a magnet rotation developing system and a two-component developing agent used in the image forming apparatus, said developing agent containing a magnetic toner and a carrier.

An image forming apparatus using a magnet rotation type developing system is disclosed in, for example, Japanese Patent Publication (Kokoku) No. 7-40156. The apparatus disclosed in this prior art comprises a developing roller arranged to face an image carrier carrying an electrostatic latent image. The developing roller includes a hollow cylindrical rotatable sleeve made of a non-magnetic material and a magnetic roll arranged within the sleeve, having a plurality of magnetic poles, and rotatable independently of the sleeve.

In the magnet rotation developing system, a two component system developing agent consisting of a magnetic carrier and a magnetic toner having a magnetic material added to the surface of a magnetic toner particle is applied to a developing roll, and the magnetic roll and the sleeve are rotated in the same or opposite directions so as to supply the developing agent into a developing region while allowing the developing agent particles to rotate about their own axes. In the magnet rotation type developing system of this type, the toner specific concentration can be controlled easily, compared with the ordinary magnet stationary developing system, making it possible to increase the toner specific concentration. It follows that the toner transfer amount is increased so as to improve the developing efficiency. Where the magnet roll and the sleeve are rotated in the same direction, the rotating direction of the developing agent about its own axis is opposite to the transfer direction of the developing agent. Where the magnet roll and the sleeve are rotated in the opposite direction, however, the rotating direction of the developing agent about its own axis is equal to the transfer direction of the developing agent, making it possible to further increase the transfer amount of the developing agent. Therefore, the particular rotating directions of the magnet roll and the sleeve is adapted for a high speed development.

In general, the toner specific concentration on the developing roll is about 6% by weight in the two component developing agent of the magnet stationary developing system. On the other hand, the toner specific concentration on the developing roll can be maintained at about 50% in the two component developing agent of the magnet rotation developing system, leading to the merit that a so-called "carrier attachment", i.e., the phenomenon that the carrier is attached to the developing roll, is unlikely to take place.

It is of high importance in this technical field to form stably excellent images high in image concentration and low in fogging by using the two component system developing agent of the magnet rotation developing system.

BRIEF SUMMARY OF THE INVENTION

An object of the present invention, which has been achieved in view of the situation described above, is to provide a developing agent capable of forming images high in image concentration and low in fogging.

Another object of the present invention is to provide an image forming apparatus that permits forming images high in image density and low in fogging.

According to a first aspect of the present invention, there is provided a developing agent, comprising a toner particle containing a magnetic powder and a binder resin, wherein the developing agent has a kinetic resistance of 200 MΩ or less and the absolute value of the difference ΔV between the maximum value and the minimum value of the surface potential of the developing sleeve supporting the developing agent is not larger than 5V.

According to a second aspect of the present invention, there is provided an image forming apparatus, comprising:

at least one image carrier;

a developing device including a hollow cylindrical rotatable sleeve arranged to face the image carrier, housing a developing agent including a toner particle containing a magnetic powder and a binder resin, the developing agent having a kinetic resistance of 200 MΩ or less, and the absolute value of the difference ΔV between the maximum value and the minimum value of the surface potential of the developing sleeve supporting the developing agent being 5V or less, and a magnet roll rotatable independently of the sleeve and having a plurality of magnetic poles, the developing agent supported on the developing sleeve being supplied to an electrostatic latent image formed on the image carrier so as to form a developing agent image;

a transfer device for transferring the developing agent image into a transfer material; and a fixing device for fixing the transferred developing agent image.

The image forming apparatus of the present invention makes it possible to form developing agent images satisfactory in image density and low in fogging.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The developing agent of the present invention comprises a toner particle containing a magnetic powder and a binder resin. The kinetic resistance of the developing agent is not higher than 200 MΩ, and the absolute value of the difference ΔV between the maximum value and the minimum value of the surface potential of the developing sleeve supporting the developing agent is not larger than 5V.

On the other hand, the image forming apparatus of the present invention, to which the developing agent described above is applied, comprises at least one image carrier, a developing device including a hollow cylindrical rotatable sleeve arranged to face the image carrier, housing a developing agent comprising a toner particle containing a magnetic powder and a binder resin, said developing agent having a kinetic resistance of 200 MΩ or less and the absolute value of the difference between the maximum value and the minimum value of the surface potential of the developing sleeve supporting the developing agent being not larger than 5V, and a magnet roll having a plurality of magnetic poles and rotatable independently of the sleeve, a transfer device, a cleaning device, and a fixing device having a pair of fixing rollers arranged below the transfer device.

It is possible to add the magnetic powder used in the present invention in, for example, the melting-kneading step during manufacture of the toner particle so as to permit the magnetic powder to be contained in the inner region of the toner particle. Alternatively, it is possible to add the magnetic powder to the toner particle so as to permit the magnetic powder to be attached to the surface of the toner particle. Further, it is also possible to employ these two techniques in combination.

The magnetic powder is capable of acting as a coloring material. Also, it is possible to add a coloring material separately to the developing agent.

The term kinetic resistance used in the present specification represents the minimum resistance in the case where an aluminum conductive drum is used in place of the photoreceptor drum and the developing agent is supplied from the developing sleeve onto the aluminum conductive drum by applying voltage to the aluminum drum.

Figure 1:
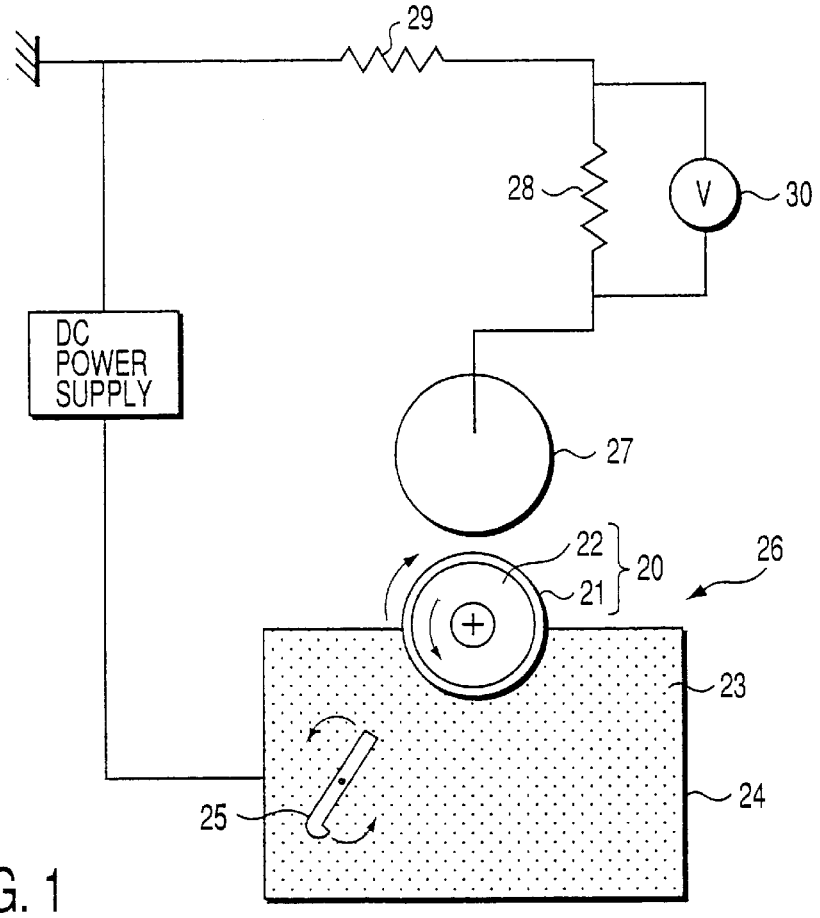
FIG. 1 shows as an example the construction of a system for measuring the kinetic resistance of the developing agent used in the present invention.

FIG. 1 exemplifies the construction of a system for measuring the kinetic resistance of the developing agent used in the present invention. As shown in the drawing, the measuring system comprises a developing agent container 24 containing a developing agent 23, a developing section 26 consisting of a developing roller 20 arranged above the developing agent container 24, a DC power supply connected to the developing roller 20 via the developing agent container 24, an aluminum drum 27 arranged to face the developing roller 20, a resistor 28 having a resistance of 10 kΩ and another resistor 29 having a resistance of 1 MΩ, which are connected to the aluminum drum 27, and a voltage recorder 30 arranged in parallel to the resistor 28. The developing roller 20 consists of a hollow cylindrical developing sleeve 21 rotated in a clockwise direction and made of a non-magnetic material and a magnet roller 22 housed in the developing sleeve 21, having a plurality of magnetic poles extending in the axial direction, and rotated in a counterclockwise direction.

In the measuring system of the particular construction described above, the developing sleeve 21 is rotated at 1350 rpm, the magnet roller 22 is rotated at 2160 rpm, and the aluminum drum 27 is rotated at 81 rpm. As a result, the developing agent 23 is carried by the developing sleeve 21 to form a developing agent layer. Then, a developing bias voltage of 200V is applied to the DC power supply so as to permit the developing agent 23 held on the developing sleeve 21 to be supplied onto the aluminum drum 27. In this step, the voltage recorder 30 records the maximum voltage value and, then, the voltage value is gradually lowered with progress in the supply of the developing agent 23 onto the aluminum drum 27, finally reaching zero volt. The kinetic resistance can be easily obtained from the maximum voltage value and the applied developing bias voltage. The resistance values of the resistors 28 and 29 are on the order smaller than a decimal point, compared with the calculated kinetic resistance and, thus, is negligible.

The minimum resistance value measured by the apparatus shown in FIG. 1 can be regarded as the kinetic resistance at the instant when the electrostatic latent image is developed with the developing agent.

On the other hand, the surface potential of the developing sleeve carrying the developing agent can be measured by, for example, a Monlow surface potentiometer.

Figure 2:
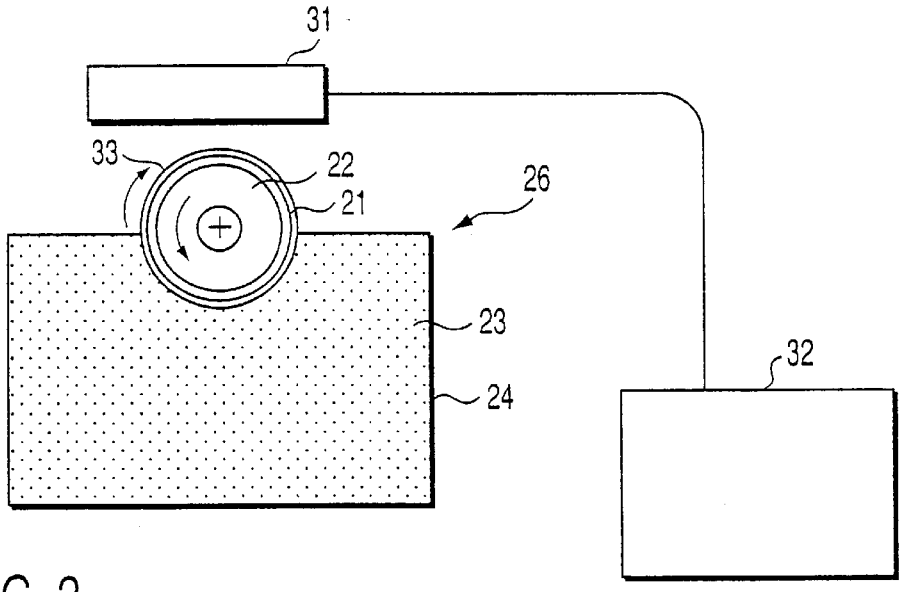
FIG. 2 shows how the surface potential of the developing sleeve supporting a developing agent is measured.

FIG. 2 shows how the surface potential of the developing sleeve carrying the developing agent will be measured.

As shown in the drawing, prepared is a developing section 26 equal in construction to the developing section shown in FIG. 1. In the first step, the developing sleeve 21 is rotated at 1350 rpm, and the magnet roller 22 is rotated 2160 rpm. As a result, the developing agent 23 is carried by the developing sleeve 21 so as to form a developing agent layer 33. Then, a probe 31 connected to a Monlow surface potentiometer is arranged above the developing layer 33. The surface potential of the developing agent layer 33 can be measured like the ordinary measurement of the surface potential of the photoreceptor by using the Monlow surface potentiometer. The maximum value and the minimum value of the surface potential can be obtained by measuring the surface potential covering one complete rotation of the rotating developing sleeve 21. The difference between the maximum and the minimum values thus obtained is represented by ΔV, which substantially conforms with the irregularity on the surface of the developing agent layer.

In the present invention, the kinetic resistance of the developing agent is set at 200 MΩ or less, and the absolute value of the difference ΔV between the maximum value and the minimum value of the surface potential of the developing sleeve carrying the developing agent is set at 5V or less. As a result, the resistance value at the instant when the electrostatic latent image is developed with the developing agent and the irregularity on the surface of the developing agent layer are defined so as to make it possible to obtain images high in image density and free from fogging.

Figure 3:
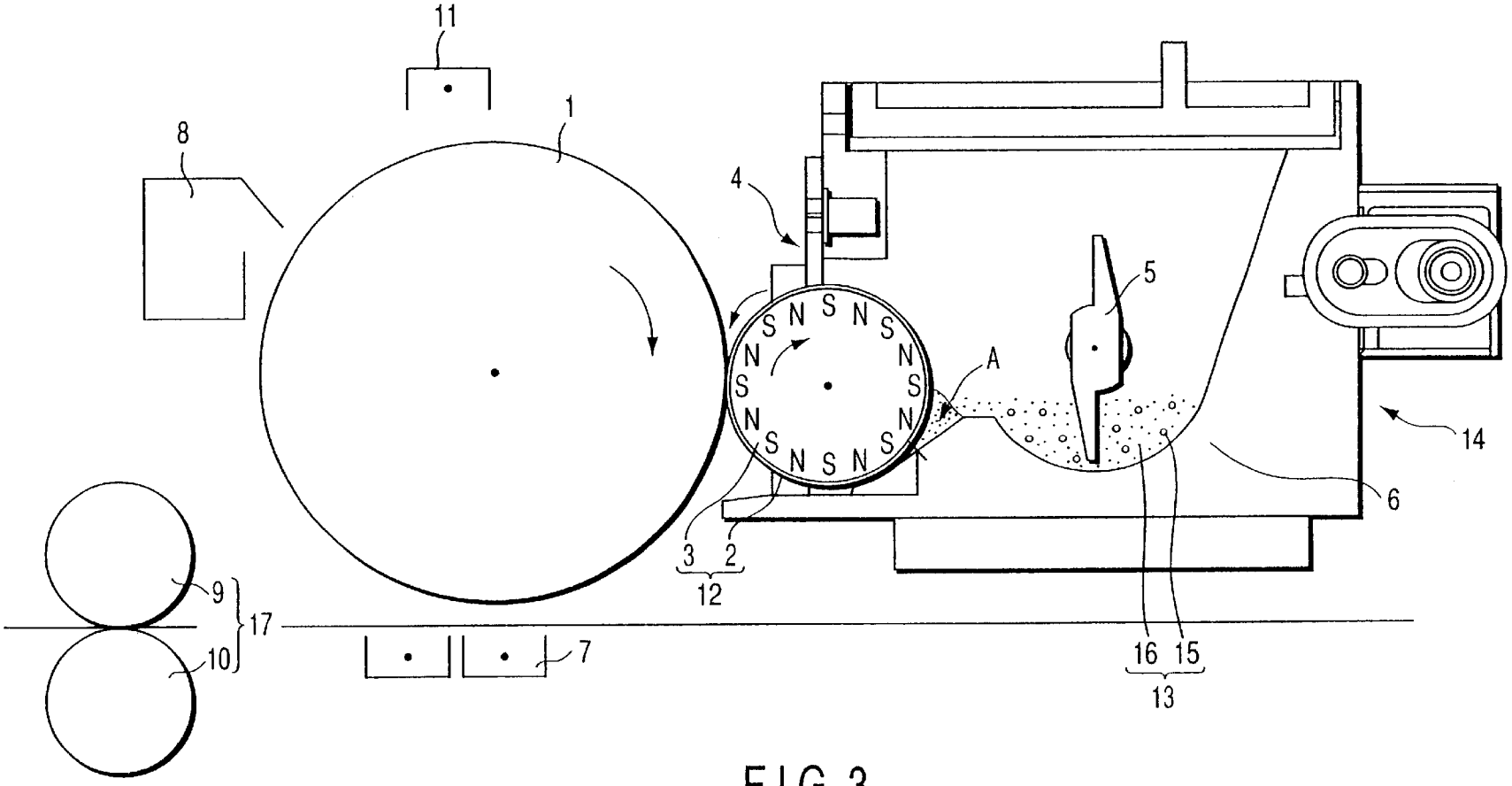
FIG. 3 schematically shows as an example the construction of an image forming apparatus of the present invention.

FIG. 3 schematically exemplifies the construction of an image forming apparatus according to one embodiment of the present invention. As shown in the drawing, the image forming apparatus comprises a photoreceptor drum 1 acting as an image carrier. A developing device 14, a transfer device 7, a cleaning device 8, a charging device 11, and a fixing device 17 are arranged around the photoreceptor drum 1 in the order mentioned in the rotating direction of the photoreceptor drum 1 denoted by an arrow. The fixing device 17 arranged downstream of the transfer device 7 in the rotating direction of the photoreceptor drum 1 consists of a pair of fixing rollers 9 and 10.

The photoreceptor drum 1 bearing an electrostatic latent image on the surface is rotated in the direction denoted by the arrow. The developing device 14 arranged to face the photoreceptor drum 1 is constructed as described below. Specifically, the developing device 14 includes a developing agent housing section 6 formed integral with an envelope to which a toner cartridge can be mounted. A developing agent 13 of the present invention is housed in the developing agent housing section 6. The developing agent 13 is a two component system developing agent containing a toner 16 and a carrier 15. The developing agent has a kinetic resistance of 200 MΩ or less, and the absolute value of the difference ΔV between the maximum value and the minimum value of the surface potential of the developing sleeve carrying the developing agent is 5V or less. A developing roller 12 is arranged in a lower end portion of the developing device 14 in a manner to face the photoreceptor drum 1. The developing roller 12 comprises a hollow cylindrical developing sleeve 2 made of a non-magnetic material and a magnet roller 3 housed in the developing sleeve 2 and having a plurality of magnetic poles extending in the axial direction. The developing sleeve 2 and the magnet roller 3 are arranged coaxial and rotatable relative to each other. In the developing device 14, the developing sleeve 2 is rotated in the clockwise direction, and the magnet roller 3 is rotated in the counter-clockwise direction. As a result, the developing agent having the toner 16 supported on the carrier 15 is rotated on its own axis in a direction equal to the transfer direction of the developing agent so as to make it possible to increase the transfer amount of the developing agent. It follows that the electrostatic latent image can be developed at a high speed. The developing device 14 also includes a developing agent regulating blade 4 made of a non-magnetic material and a stirrer 5 for stirring the developing agent 13 so as to prevent the developing agent 13 from being agglomerated and, at the same time, to transfer the developing agent toward the developing roller 12.

In this embodiment, the gap between the photoreceptor drum 1 and the developing sleeve 2 is 0.35 mm. On the other hand, the gap between the developing agent regulating blade 4 and the developing sleeve 2 is 0.30 mm.

The magnetic toner is stirred by the stirrer 5 and supplied during the stirring to a magnetic suction region A of the developing agent. The magnetic toner magnetically sucked in the magnetic suction region A of the developing agent is sucked on the developing sleeve 2. Also, during rotation of the magnet roller 3, the magnetic carrier 15 is rotated and stirred together with the toner 16, with the result that the magnetic toner is electrically charged.

It is desirable for a ratio of the toner weight to the weight of the developing agent on the developing sleeve 2, i.e., a toner specific concentration, should desirably be about 40 to 60%. In this embodiment, the toner specific concentration is maintained at about 50%. In other words, the toner amount relative to the magnetic carrier is large in this embodiment, compared with the conventional two-component developing system of a magnet stationary type. It should also be noted in respect of the range of fluctuation in the toner concentration that inconveniences such as the carrier attachment and decrease in the concentration tend to be generated in the conventional magnet stationary type developing system unless the toner specific concentration is maintained at ±1% by weight of the desired value, making it necessary to strictly control the toner specific concentration. In the magnet rotation type developing system of the present invention, however, no inconvenience is generated in the developed image even if the toner specific concentration is fluctuated within a range of ±20% by weight of the desired value. The developing agent transferred on the sleeve 2 passes through the clearance below the developing agent regulating blade 4 so as to form a developing agent layer of a predetermined thickness and, thus, to develop the electrostatic latent image formed on the photoreceptor drum 1.

The developing agent image formed on the photoreceptor drum 1 is transferred by the transfer device 7 onto a transfer material. On the other hand, the toner remaining on the photoreceptor drum 1 is removed and recovered by the cleaning device 8. On the other hand, the transfer material having the developing agent image transferred thereonto is introduced into the clearance between the fixing rollers 9 and 10 of the fixing device 17 arranged downstream of the transfer device 7 in the rotating direction of the photoreceptor drum 1 so as to fix the developing agent image onto the transfer material and, thus, to form the developing agent image.

In the apparatus described above, the developing agent used has a kinetic resistance of 200 MΩ or less, and the absolute value of the difference ΔV between the maximum value and the minimum value of the surface potential of the developing sleeve bearing the developing agent is 5V or less. It follows that, by using the particular image forming apparatus, the resistance value at the instant when the electrostatic latent image is developed by the developing agent and the irregularity on the surface of the developing agent are defined so as to make it possible to obtain a developing agent image high in image density and free from fogging.

It is possible to use preferably a magnetite such as $Fe_3O_4$ as a magnetic powder. It is desirable for the magnetic powder to have a particle diameter of 0.1 to 0.3 $\mu$m.

Where the magnetic powder is contained in the toner or is added to the outer surface of the toner particle, it is possible to use the same magnetic powder or to use in combination magnetic powders differing from each other in composition, particle diameter, etc.

It is possible to use, for example, styrene-acrylic resin as the binder resin.

The black coloring material used in the present invention includes various carbon blacks manufactured by, for example, a thermal black method, an acetylene black method, a channel black method, a furnace black method and a lamp black method.

It is also possible to use a wax such as a low molecular weight polypropylene, a low molecular weight polyethylene, a liquid paraffin, an acid amide, a stearic acid wax, a montan-based wax, a sazol wax, a castor wax, chlorinated paraffin or carnauba wax in an amount of 0.5 to 8% by weight such that the color reproducibility of the developing agent may not be adversely affected.

The additives that can be mixed in the present invention with the toner particle include, for example, silica fine particle, metal oxide fine particle, and a cleaning assistant. The silica fine particles include fine particles of silicon dioxide, aluminum silicate, sodium silicate, zinc silicate, and magnesium silicate. The metal oxide fine particles used in the present invention include, for example, fine particles of zinc oxide, titanium oxide, aluminum oxide, zirconium oxide, strontium titanate, barium titanate, and zinc stearate. The cleaning assistants used in the present invention include, for example, resin fine particles such as fine particles of polymethyl methacrylate, polyvinylidene fluoride, and polytetrafluoroethylene. These additives are mixed, as desired, in an amount of 0.2 to 2 parts by weight based on 100 parts by weight of the toner particle. These additives, to which a surface treatment such as a hydrophobic treatment is applied, can be used in the present invention.

The toner particles can be prepared by, for example, a wet dispersion method using a high speed dissolver, a roll mill or a ball mill as a mixing-dispersing means or a melt kneading method using, for example, a roll, a pressurizing coder, an internal mixer or a screw type extruder.

Also, it is possible to use a ball mill, a V-shaped mixer, a Forberg, a Henschel mixer, etc. as a preliminary mixing means. Also, it is possible to use, for example, a hammer mill, a cutter mill, a roller mill or a ball mill as a means for roughly pulverizing a mixture of the raw materials of the toner particles. Also, it is possible to use, for example, a jet mill or a high speed rotation type pulverizer as a means for finely pulverizing the roughly pulverized material.

Also, an air stream type classifying apparatus can be used as a means for classifying the finely pulverized material.

For adding a magnetic powder to the resultant toner particles, it is possible to mix the additives with the toner particles by using a high speed rotation mixer represented by a Henschel mixer. It is possible to mix the additives simultaneously or separately depending on the kinds of the additives. In short, it is possible to mix the additives under the conditions most suitable for producing a desired effect.

EXAMPLE 1

The raw materials of the toner given below were prepared first:

Materials of Toner Particles

Styrene-acrylic resin:

| | | |
|---|---|---|
| Glass transition point | 50 to 60° C. | |
| Melt index | 110° C. | 1.0 to 3.0 g |
| | 150° C. | 3.0 to 7.0 g |
| | 190° C. | 20 to 60 g |

Molecular weight distribution by gel permeation chromatography

| | |
|---|---|
| Number average molecular weight Mn | 0.2 to 0.6 |
| Weight average molecular weight Mw | 20 to 50 |
| z average molecular weight Mz | 200 to 400 |
| | 42.5% by weight |

Polypropylene wax:

| | |
|---|---|
| (melting point 110° C. to 150° C. molecular weight 5,000 to 9,000) | 2.5% by weight |

High coercive force magnetic powder MTO-021 (manufactured by Toda Kogyo K.K.):

| | |
|---|---|
| Octahedron shape particle diameter | 0.33 μm |
| Coercive force Hc | 154 Oe |
| Residual magnetization σr | 11.6 emu/g |
| Saturation magnetization σs | 55.4 emu/g |
| | 20.0% by weight |

Low coercive force magnetic powder EPT-305 (manufactured by Toda Kogyo K.K.):

| | |
|---|---|
| Spherical shape particle diameter | 0.23 μm |
| Coercive force Hc | 58 Oe |
| Residual magnetization σr | 4.9 emu/g |

-continued

| | |
|---|---|
| Saturation magnetization σs | 84.8 emu/g |
| | 35.0% by weight |

The raw materials of the toner particles given above were melted and kneaded, followed by cooling the resultant kneaded mass and subsequently pulverizing roughly the kneaded mass by a hammer mill. Further, the roughly pulverized material was finely pulverized and classified by an I-type jet mill and a DS classifying machine so as to obtain toner particles having an average particle diameter of 9.0 μm.

Then, 0.5 part by weight of dimethyl chlorosilane having an average particle diameter of 16 mm and 35.0 parts by weight of a low coercive force magnetic powder having a spherical shape having a particle diameter of 0.30 μm, a coercive force Hc of 75 Oe, a residual magnetization σr of 8 emu/g and a saturation magnetization σs of 86 emu/g were added to 100 parts by weight of the resultant toner particles, followed by mixing the resultant mixture for 6 minutes in a Henschel mixer having an inner volume of 20 liters and rotated at 2100 rpm so as to obtain a desired toner.

The toner thus obtained was mixed with a carrier consisting of ferrite so as to prepare a two-component developing agent. The developing agent thus prepared was introduced into the kinetic resistance measuring system shown in FIG. 1 and into the measuring apparatus shown in FIG. 2 so as to measure the kinetic resistance of the developing agent at the toner specific concentration of about 50% and the surface potential of the developing agent layer on the developing roller, with the results as shown in Table 1.

Also, the two-component developing agent thus prepared was used in an image forming apparatus constructed as shown in FIG. 3 and images were formed under the conditions that the toner specific concentration was about 50%, the sleeve rotation speed was 1350 rpm, the magnet roll rotating speed was 2160 rpm, the photoreceptor drum rotating speed was 81 rpm, the process speed was 127 mm/sec, the paper feeding speed was 25 paper sheets/min, the distance between the developing agent regulating blade and the sleeve was 0.25 to 0.30 mm, the potential of the photoreceptor was −600V, and the developing bias voltage was −430V.

The image density and the fogging of the developing agent images thus obtained were measured, with the results as shown in Table 1. Incidentally, the image density was measured by a Macbeth reflection density measuring device. In this case, the image density of 1.4 or more is considered to be satisfactory. On the other hand, the fogging was measured by a color difference meter manufactured by Minolta Inc. In this case, if the back ground (BG) obtained by the color difference meter is 1 or less, the fogging is considered to be low and, thus, the developing agent image is considered to be satisfactory.

EXAMPLE 2

Toner particles were obtained as in Example 1 by using the raw materials of the toner given below:

Styrene-acrylic resin similar to that used in Example 1 . . . 39 parts by weight Polypropylene wax similar to that used in Example 1 . . . 5 parts by weight Intermediate coercive force magnetic powder EPT-1002 (manufactured by Toda Kogyo K.K.)

| | |
|---|---|
| Octahedron shape particle diameter | 0.23 μm |
| Coercive force Hc | 125 Oe |
| Residual magnetization σr | 10 emu/g |
| Saturation magnetization σs | 83 emu/g |
| | 55.0% by weight |
| Charge control agent (iron-containing azo complex body) | 1.0 part by weight |

Then, toner was prepared as in Example 1 by adding 0.5 part by weight of hexamethylene disilazane having an average particle diameter of 12 nm, 2 parts by weight of an intermediate coercive force magnetic powder EPT-1002, 0.05 part by weight of zinc stearate manufactured by Nippon Fat and Oil K.K. and having a melting point of 110 to 150° C., and 0.05 part by weight of a low molecular weight ethylene fluoride resin L-5F manufactured by Daikin Kogyo K.K., having a particle diameter of 3 to 7 μm, a melting point of about 327° C., and a true specific gravity of 2.2 to 100 parts by weight of the toner particles thus obtained.

A developing agent was obtained as in Example 1 by using the resultant toner.

In respect of the developing agent thus obtained, the kinetic resistance of the developing agent, the surface potential of the developing layer on the developing roller, the image density and the fogging were measured as in Example 1, with the results as shown in Table 1.

EXAMPLE 3

Toner particles having an average particle diameter of 11.0 μm were obtained as in Example 1, except that the raw materials of the toner particles consisted of 40 parts by weight of styrene-acrylic resin similar to that used in Example 1, 5 parts by weight of polypropylene wax similar to that used in Example 1 and 55 parts by weight of the intermediate coercive force magnetic powder EPT-1002.

Then, toner was prepared as in Example 1 by adding 0.5 part by weight of hexamethylene disilazane having an average particle diameter of 12 nm, 2 parts by weight of an intermediate coercive force magnetic powder EPT-1002, and 0.05 part by weight of zinc stearate manufactured by Nippon Fat and Oil K.K. and having a melting point of 110 to 150° C.

A developing agent was obtained as in Example 1 by using the resultant toner.

In respect of the developing agent thus obtained, the kinetic resistance of the developing agent, the surface potential of the developing layer on the developing roller, the image density and the fogging were measured as in Example 1, with the results as shown in Table 1.

EXAMPLE 4

Toner particles were obtained as in Example 1 by using the raw materials of the toner particles similar to those used in Example 2.

Then, toner was prepared by adding 0.7 part by weight of hexamethylene disilazane having an average particle diameter of 12 nm, 2 parts by weight of an intermediate coercive force magnetic powder EPT-1002, and 0.1 part by weight of zinc stearate manufactured by Nippon Fat and Oil K.K. and having a melting point of 110 to 150° C. to 100 parts by weight of the resultant toner particles, followed by mixing the resultant mixture for 6 minutes within a Henschel mixer having an inner volume of 300 liters and rotated at 900 rpm.

A developing agent was obtained as in Example 1 by using the resultant toner.

In respect of the developing agent thus obtained, the kinetic resistance of the developing agent, the surface potential of the developing layer on the developing roller, the image density and the fogging were measured as in Example 1, with the results as shown in Table 1.

EXAMPLE 5

Toner particles were obtained as in Example 1 by using the raw materials of the toner particles similar to those used in Example 2.

Then, toner was prepared by adding 0.7 part by weight of hexamethylene disilazane having an average particle diameter of 12 nm, 2 parts by weight of an intermediate coercive force magnetic powder EPT-1002, and 0.1 part by weight of zinc stearate manufactured by Nippon Fat and Oil K.K. and having a melting point of 110 to 150° C. to 100 parts by weight of the resultant toner particles.

A developing agent was obtained as in Example 1 by using the resultant toner.

In respect of the developing agent thus obtained, the kinetic resistance of the developing agent, the surface potential of the developing layer on the developing roller, the image density and the fogging were measured as in Example 1, with the results as shown in Table 1.

COMPARATIVE EXAMPLE 1

Toner particles were obtained as in Example 1 by using the raw materials of the toner given below:

Styrene-acrylic resin similar to that used in Example 1 . . . 39 parts by weight Polypropylene wax similar to that used in Example 1 . . . 5 parts by weight Charge control agent (iron-containing azo complex body) . . . 1.0 part by weight High coercive force magnetic powder MTO-021 . . . 20.0 parts by weight Low coercive force magnetic powder EPT-305 . . . 35.0 parts by weight Then, toner was prepared as in Example 1 by adding 0.5 part by weight of dimethyl dichloro silane having an average particle diameter of 16 mm, 2 parts by weight of a low coercive force magnetic powder BL500, and 0.1 part by weight of zinc stearate manufactured by Nippon Fat and Oil K.K. and having a melting point of 110 to 150° C. to 100 parts by weight of the resultant toner particles.

A developing agent was obtained as in Example 1 by using the resultant toner.

In respect of the developing agent thus obtained, the kinetic resistance of the developing agent, the surface potential of the developing layer on the developing roller, the image density and the fogging were measured as in Example 1, with the results as shown in Table 1.

COMPARATIVE EXAMPLE 2

Toner particles were obtained as in Example 1 by using the raw materials of the toner particles similar to those used in Comparative Example 1.

Then, toner was prepared as in Example 1 by adding 0.5 part by weight of dimethyl dichloro silane having an average particle diameter of 16 mm, 4.5 parts by weight of a low coercive force magnetic powder BL500, and 0.1 part by weight of zinc stearate manufactured by Nippon Fat and Oil K.K. and having a melting point of 110 to 150° C. to 100 parts by weight of the resultant toner particles.

A developing agent was obtained as in Example 1 by using the resultant toner.

In respect of the developing agent thus obtained, the kinetic resistance of the developing agent, the surface potential of the developing layer on the developing roller, the image density and the fogging were measured as in Example 1, with the results as shown in Table 1.

TABLE 1

| | Output voltage (mv) | Kinetic resistance of developing agent (MΩ) | Sleeve surface potential (V) Minimum value | Maximum value | ΔV | Image density | Fogging | Judgment |
|---|---|---|---|---|---|---|---|---|
| Example 1 | 17 | 118 | −58 | −59 | −1 | 1.49 | 0.45 | ○ |
| Example 2 | 12.5 | 160 | −106 | −107 | −1 | 1.53 | 0.58 | ○ |
| Example 3 | 12 | 167 | −114 | −116 | −2 | 1.49 | 0.50 | ○ |
| Example 4 | 20 | 100 | −94 | −96 | −2 | 1.57 | 0.54 | ○ |
| Example 5 | 21 | 95 | −106 | −108 | −2 | 1.55 | 0.60 | ○ |
| Comparative Example 1 | 8 | 250 | −86 | −93 | −7 | 1.37 | 1.31 | x |
| Comparative Example 2 | 12 | 167 | −54 | −65 | −11 | 1.50 | 2.09 | x |

As apparent from Table 1, where the kinetic resistance of the developing agent is not higher than 200 MΩ and the absolute value of the difference ΔV between the maximum value and the minimum value of the surface potential of the developing sleeve carrying the developing agent is not larger than 5V as in Examples 1 to 5, it is possible to obtain satisfactory developing agent image having an image density not lower than 1.4 and fogging not larger than 1. On the other hand, the absolute value of the difference ΔV noted above exceeds 5V in Comparative Example 1, though the kinetic resistance of the developing agent is not higher than 200 MΩ. In this case, it is certainly possible to obtain an image density not lower than 1.4. However, the fogging exceeds 1.0, resulting in failure to obtain a satisfactory developing agent image. Further, in Comparative Example 2, the kinetic resistance of the developing agent exceeds 200 MΩ, and the absolute value of the difference ΔV noted above also exceeds 5V. In this case, it was possible to obtain an image density not lower than 1.4. However, the fogging was large, resulting in failure to obtain a satisfactory developing agent image.

Figure 4:
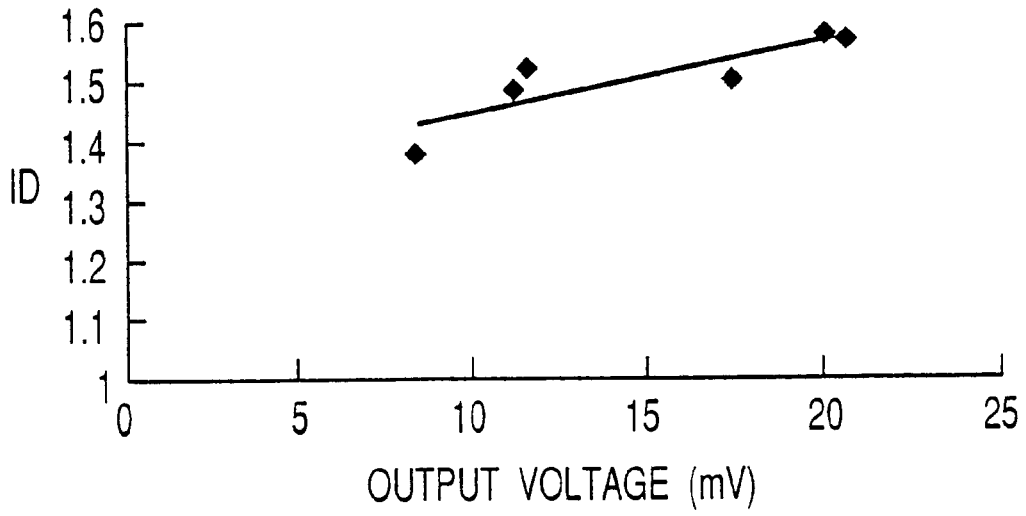
FIG. 4 is a graph showing the relationship between the output voltage measured for obtaining the kinetic resistance and the image density.
Figure 5:
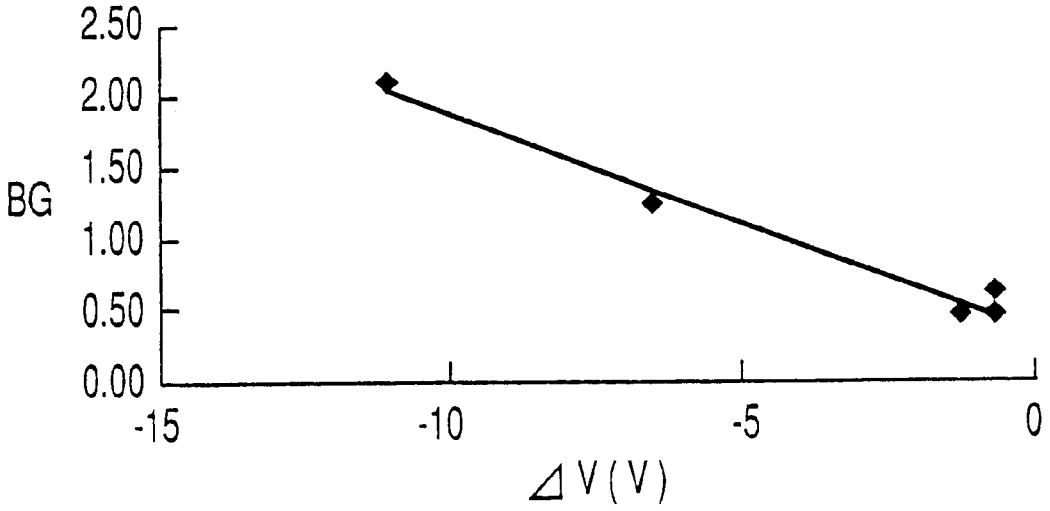
FIG. 5 is a graph showing the relationship between the absolute value of ΔV and a BG value obtained by a color difference meter.

Further, the relationship between the output voltage and the image density and the relationship between the absolute value of the difference ΔV and the back ground (BG), which were obtained in order to obtain the kinetic resistance of the developing agent in the Examples and the Comparative Examples, are shown in FIGS. 4 and 5, respectively.

As apparent from FIGS. 4 and 5, the measured values are plotted substantially linearly. The graph of FIG. 4 indicates that, in order to obtain an image density sufficiently higher than 1.4, it is necessary to set the output voltage at about 10 mV or more, which corresponds to a resistance not higher than about 200 MΩ. On the other hand, the graph of FIG. 5 indicates that, in order to set the fogging sufficiently lower than 1.0, it is necessary for the absolute value of ΔV to be not larger than about 5V.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent, comprising a toner particle containing a magnetic powder and a binder resin, wherein said developing agent has a kinetic resistance of 200 MΩ or less and the absolute value of the difference ΔV between the maximum value and the minimum value of the surface potential of the developing sleeve supporting the developing agent is not larger than 5V, wherein said kinetic resistance of the developing agent represents the minimum resistance in the case where voltage is applied between a developing sleeve supporting said developing agent and a conductive drum arranged to face said developing sleeve and said developing agent is supplied from said developing sleeve onto said conductive drum.

2. The developing agent according to claim 1, wherein said developing agent contains a carrier, and the weight ratio of the toner to the weight of the developing agent is 40 to 60% by weight.

3. The developing agent according to claim 1, wherein said magnetic powder consists essentially of magnetite.

4. The developing agent according to claim 1, wherein a carrier has a particle diameter of 50 to 70 $\mu$m.

5. A developing agent, comprising a toner particle containing a magnetic powder and a binder resin, wherein said developing agent has a kinetic resistance of 200 MΩ or less and the absolute value of the difference ΔV between the maximum value and the minimum value of the surface potential of the developing sleeve supporting the developing agent is not larger than 5V, wherein said developing agent is applied to an image forming apparatus comprising:

at least one image carrier;

a developing device including a hollow cylindrical rotatable sleeve;

a developing agent comprising said toner particle; and a magnet roll having a plurality of magnetic poles and rotatable independently and in an opposite direction of the sleeve, a transfer device, a cleaning device, and a fixing device having fixing rollers below the transfer device, wherein said kinetic resistance of the developing agent represents the minimum resistance in the case where voltage is applied between a developing sleeve supporting said developing agent and a conductive drum arranged to face said developing sleeve and said developing agent is supplied from said developing sleeve onto said conductive drum.

6. The developing agent according to claim 5, wherein said developing agent contains a carrier, and the weight ratio of the toner to the weight of the developing agent is 40 to 60% by weight.

7. The developing agent according to claim 5, wherein said magnetic powder consists essentially of magnetite.

8. The developing agent according to claim 5, wherein a carrier has a particle diameter of 50 to 70 $\mu$m.

9. The developing agent according to claim 5, wherein the magnetic powder is capable of acting as a coloring material.

* * * * *